United States Patent [19]

Bladt

[11] Patent Number: 4,887,711

[45] Date of Patent: Dec. 19, 1989

[54] CIGARETTE AND MATCHES CONTAINER

[76] Inventor: Detlev V. Bladt, 1274 Tam O'Shanter, Azusa, Calif. 91702

[21] Appl. No.: 350,613

[22] Filed: May 10, 1989

[51] Int. Cl.[4] ..... A24F 15/00; A24F 27/20; A24F 27/00; B65D 77/24

[52] U.S. Cl. ..... 206/92; 206/90; 206/100; 206/236

[58] Field of Search ..... 206/86, 90, 91, 92, 206/93, 94, 95, 98, 99, 100, 236, 249, 250, 804; 229/146, 160.1

[56] References Cited

U.S. PATENT DOCUMENTS

| | | | |
|---|---|---|---|
| 893,551 | 7/1908 | Schmidt | 206/91 |
| 3,065,849 | 11/1962 | Rice et al. | 206/92 |
| 3,115,241 | 12/1963 | Ast | 206/92 |
| 3,509,989 | 5/1970 | Woll | 206/100 |

*Primary Examiner*—Stephen Marcus
*Assistant Examiner*—Jacob K. Ackun
*Attorney, Agent, or Firm*—Boniard I. Brown

[57] ABSTRACT

A cigarette and matches container has front, rear, bottom and sidewalls forming a box, a lid hinged to a rear wall upper portion for movement between open and closed lid positions, and a panel mounted in parallel confronting relation with the rear wall and defining therewith a channel with a lower opening. A match set is disposed in the channel and has a base with individual matches extending therefrom. One or more pull strips are connected at upper ends to the lid and at lower ends to the match set base so that upon movement of the lid from closed to open position, the pull strip moves relative to the box rear wall to move the match set to a position wherein portions of the matches extend outwardly from the channel for manual grasping by a user. The matches may be secured to the match base with their heads remote from the base so that with the lid in open position the heads extend outwardly from the channel opening. In one form of the invention, the heads of the matches are detachably retained on the match set base so that with the lid in open position the stems extend outwardly from the channel opening. Confronted abrasive striking surfaces may be provided on the box rear wall and on the panel to produce striking of the match upon its being withdrawn in the form of the container wherein the match stems extend outwardly from the channel.

17 Claims, 2 Drawing Sheets

CIGARETTE AND MATCHES CONTAINER

BACKGROUND OF THE INVENTION

The present invention relates to an improved combination cigarette and matches container.

Many persons who smoke cigarettes often find themselves with a package containing cigarettes with no matches or means for lighting the same. Cigarette smokers typically carry packages of matches or cigarette lighters on their persons, but is common for a person to lack means for lighting a cigarette at the time of need.

The process of providing a lighted cigarette, without a special combination package, can conventionally be inefficient, inconvenient and awkward. After producing a package of cigarettes from the person's clothing or elsewhere, the package must be opened, a cigarette removed, the package closed, the package returned to its place of storage, a book of matches or a cigarette lighter must be produced, opened, then a match must be struck or the lighter operated, then closed and returned to the clothing of the person or other place of storage.

A number of expedients have heretofore been proposed to improve upon the above-outlined procedure and to overcome the disadvantages of the conventional procedure of preparation of a cigarette for smoking. These have respective disadvantages, including the inefficiency involved because of the sequence of steps required, the somewhat difficult, excessive or awkward movements utilized in drawing and igniting a match while holding the container, or not having matches positioned for ease and convenience of manual grasping while holding the container.

Certain examples of prior art expedients are disclosed in the following patents: U.S. Pat. No. 1,726,8432 to Kornsweet relates to an arrangement wherein matches are elevated by spring action upon the opening of a container lid; Patent No. 3,017,9182 to Hardychuk relates to a telescoping container wherein cigarettes are elevated in an inner telescoping element by pulling a lid, and matches are cammed to extend outwardly at the side of the container by such action; Patent No. 3,021,9442 to Moore, utilizes a manually operable slider moving in slots to elevate matches adjacent to cigarettes in the container; and Pat. No. 2,975,8902 to Block discloses a container having a flap covering matches on a wall of a container, which flap drops open to expose the matches when a container lid is opened.

SUMMARY OF THE INVENTION

The present invention provides a cigarette and matches container having front, rear, bottom and sidewalls which cooperate to define a box, a lid hinged on the rear wall for movement between an open and a closed position, and a panel on the box in confronting relation with the rear wall and forming therewith a channel having a lower opening. A match set is disposed in the channel and has a plurality of individual matches extending from a base. At least one pull strip has its upper end portion connected to the lid and its lower end portion to the match set, and is slidable relative to the box rear wall, so that upon movement of the lid from its closed to its open position, the pull strip moves relative to the box rear wall and the channel to move the match set to extend portions of the matches outwardly from the channel opening for manual grasping. In one form of the container of the invention, the matches are detachably secured to a match base with their heads remote from the base which is so positioned that when the lid is in its open position the matches extend outwardly from the channel opening. In another form of the container of the invention, the matches' heads are detachably retained on a match base which is so positioned that with the lid in its open position the match stems extend outwardly from the channel opening. In the latter form of the container, a pair of abrasive match striking surfaces are provided in confronting relation, one on the box rear wall and the other on the channel adjacent to the channel opening.

DESCRIPTION OF THE PREFERRED EMBODIMENTS

Figure 1:
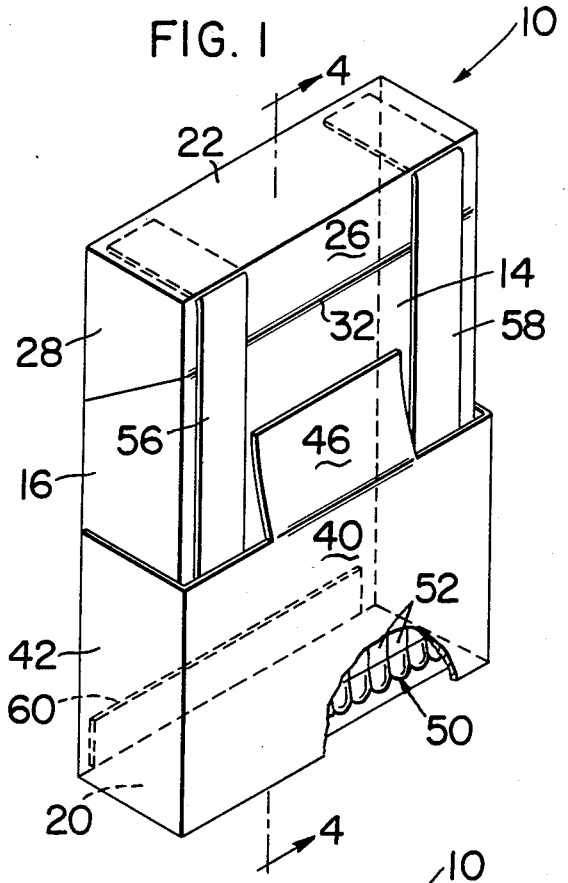
FIG. 1 is a perspective view of a cigarette and matches container according to the invention, showing the container in closed configuration.
Figure 2:
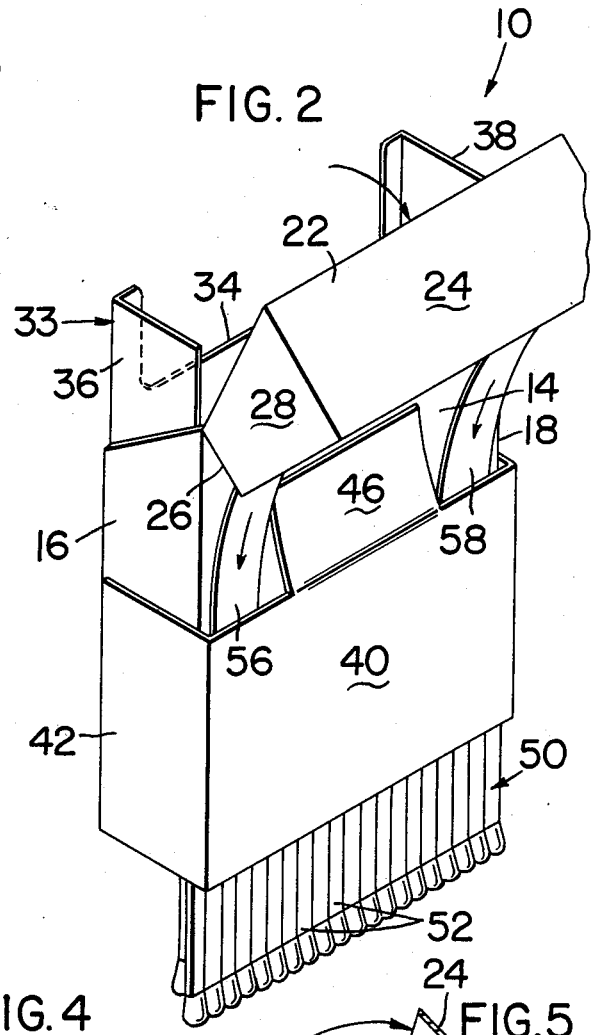
FIG. 2 is a perspective view of the container of FIG. 1, showing the container in its open configuration with a match set extended from the container.
Figure 3:
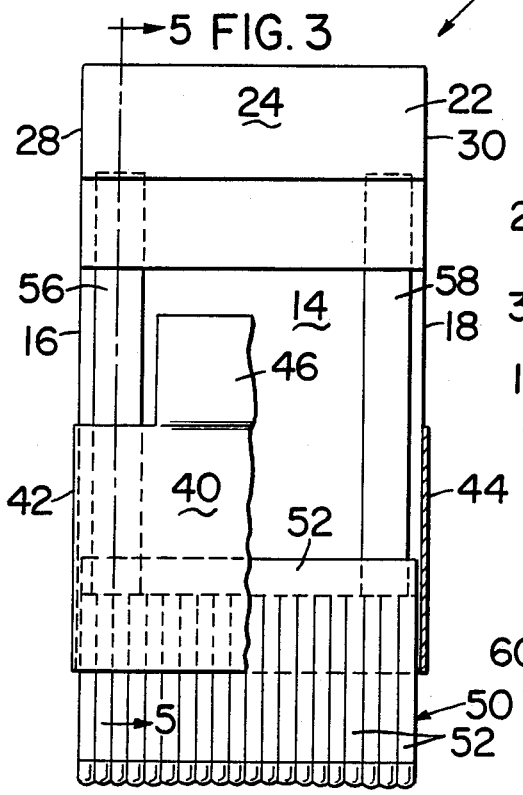
FIG. 3 is a rear elevational view, partially in section, of the container of FIGS. 1 and 2, showing a match set extending from the container.

Referring to the drawings, FIGS. 1 to 5 illustrate a preferred embodiment of a cigarette and match container 10 according to the invention. As shown, the container comprises a box having a front wall 12, a rear wall 14, side walls 16, 18 and a bottom wall 20.

It may be noted that the fabrication of basic containers of the general type of the container utilized with the invention, are well-known in the art, and fabrication details have therefore been omitted from the drawings and description.

A lid or cover 22 normally closes the box, and has a front wall 24, rear wall 26, and side walls 28, 30 which are so sized and configurated that in the closed position of the lid (FIGS. 1 and 4), the edges of the lid walls engage the upper edges of the box walls, as shown. The lid is integrally connected with the rear wall 14 along a transverse fold line 32 for rotational movement of the lid between its closed position of FIG. 1 and its open position of FIG. 2.

An inner liner insert 32 is disposed within the box, and has a front panel 34 extending along box front wall 24 and side flaps 36, 38 extending along side walls 16, 18 of the box. The upper portions of the liner insert walls extend above the front and side walls of the box, as shown. The upper portion of front panel 34 is cut away to provide improved manual access to cigarettes (not shown) in the container.

Figure 4:
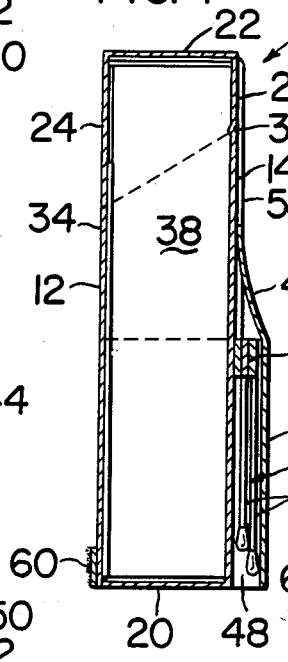
FIG. 4 is a sectional view taken at line 4—4 in FIG. 1.
Figure 5:
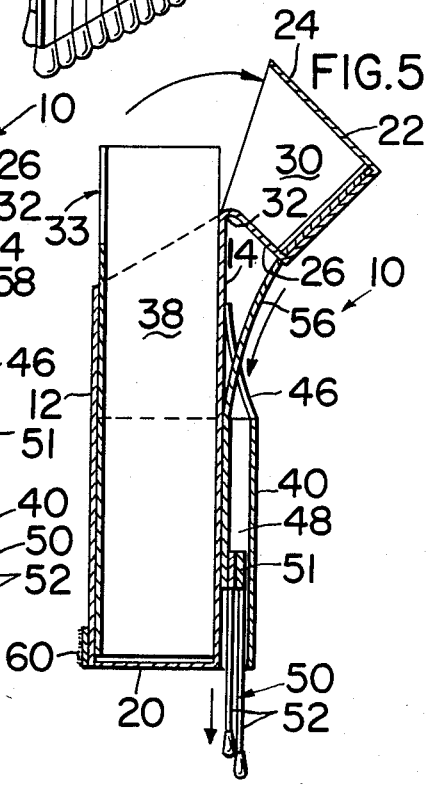
FIG. 5 is a sectional view taken at line 5—5 in FIG. 3.
Figure 6:
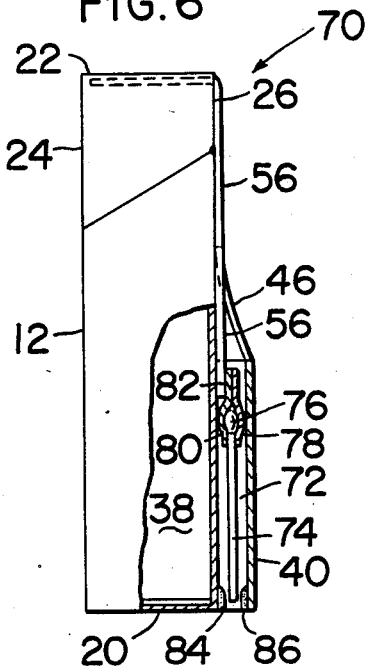
FIG. 6 is a side elevational view, partially in section, of a section embodiment of the combination cigarette and matches container of the invention.
Figure 7:
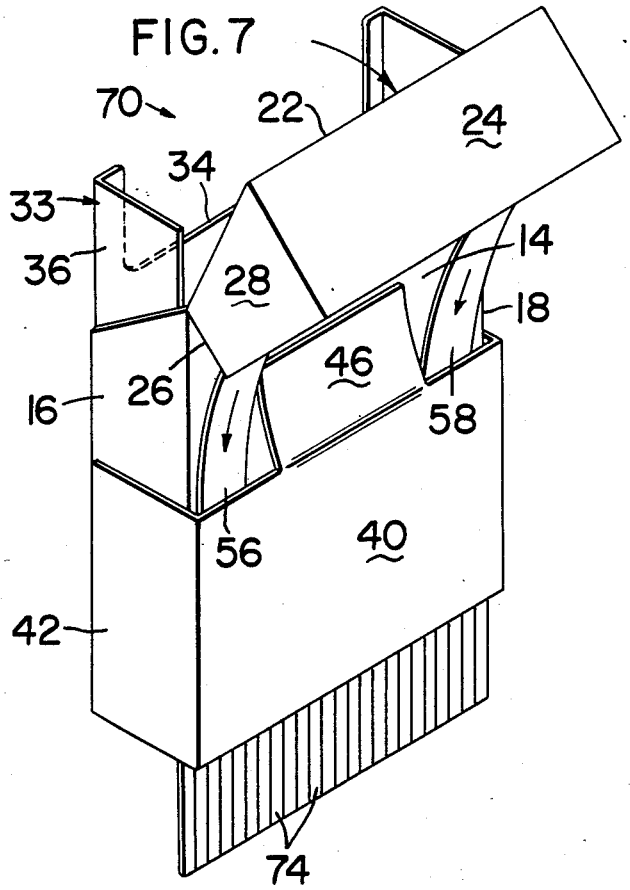
FIG. 7 is a perspective view, similar to the view of FIG. 2, showing the container of FIG. 1 in its open configuration with a match set extended from the container.
Figure 8:
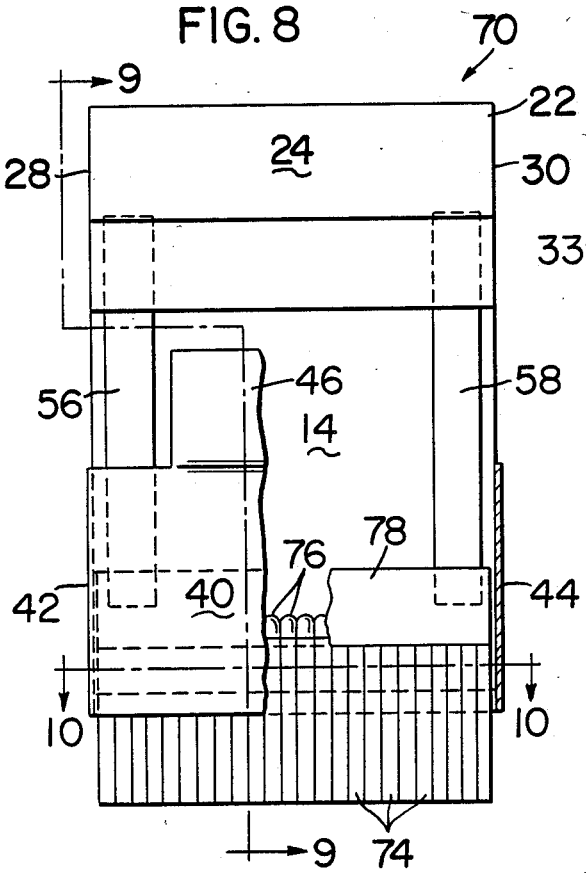
FIG. 8 is a rear elevational view, partially in section, of the container of FIGS. 6 and 7.
Figure 9:
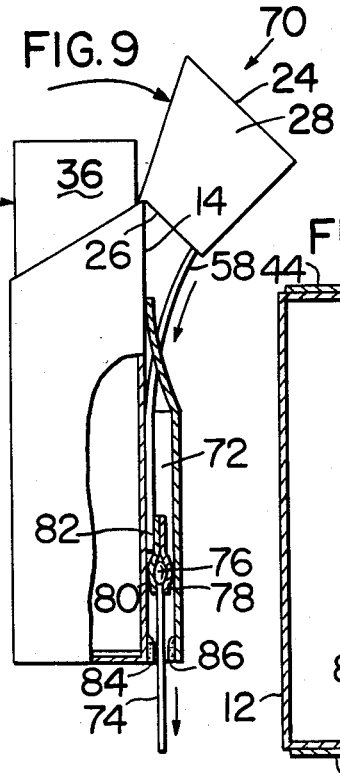
FIG. 9 is a view, partially in section, taken at line 9—9 in FIG. 8, and showing the container in its open configuration.
Figure 10:
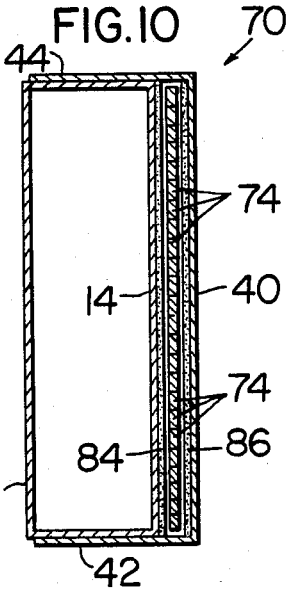
FIG. 10 is a sectional view, taken at line 10—10 in FIG. 8.

An outer panel 40 is mounted in spaced relation to rear wall 14 of the box by attachment of integrally connected flaps 42, 44 to side walls 16, 18 of the box, as by adhesive. Panel 40 and rear wall 14 of the box cooperate to define enclosure or channel 48, as best shown in FIGS. 4 and 5, which is open at its upper and lower ends. An extension 46 of panel 40 is secured, as by adhesive, to rear wall 14 of the box, and serves to prevent undesirable engagement of the box with extraneous objects, and to prevent entry of dirt and foreign objects.

A match set or packet 50, comprising a transverse match base 52 and a plurality of matches 52, is disposed in channel 48, as shown in FIGS. 4 and 5, the heads of the matches extending in the downward direction, as shown. The matches and the base 52 are typically fabricated of cardboard and integrally formed, as is conventional, thus to facilitate the ready detachment, by manual tearing, of individual matches from the match base.

According to the invention, an extension and retraction mechanism for the match set or packet comprises a pair of pull strips 56, 58 which have their upper portions extending through slots in the cover and secured to the cover, as by adhesive, and their lower end portions secured to the match base 52, as by adhesive. The pull strips extend slidably along the rear wall of the box. The pull strips are preferably formed of a material, such as plasticized paper, which is flexible and has a spring-like characteristic. The pull strips normally extend in a straightened condition, as shown in FIG. 1, with lid 22 in its closed position.

An abrasive match striking surface or strip 60 is adhesively secured to the lower portion of the front wall 12 of the box, as best shown in FIGS. 1 and 4, thus to provide a convenient match-igniting striking surface for a user.

In the operation of the device according to the invention, ready and easy accessibility of a match, for the lighting thereof, is provided. Movement of the lid from its closed position of FIG. 1 to its open position of FIG. 2, urges the pull strips downwardly, as viewed in FIG. 2, thereby extending the match set outwardly from channel 48, thus to facilitate the quick and convenient detachment and withdrawal of an individual match by manual grasping and snap-action. A user normally moves the lid to its open position of FIG. 2, removes a cigarette from the container, tears a match from the extended match packet set 50, and closes the lid. Then, with the fingers of one hand embracing the rear wall of the container, the user strikes the match on the abrasive strip 60. The positioning of the abrasive ignition strip 60, remotely relative to the match set 50, prevents ignition of the other matches.

A second embodiment of the invention is shown in FIGS. 6–10, wherein components and features of container 70 which correspond to those of the embodiment of FIGS. 1–5, are designated by the same reference numerals.

Disposed in enclosure or channel 72, which is similar to channel 48 in FIGS. 4 and 5, is a set or packet of matches which have stems 74 extending downwardly, and match heads 76 which are resiliently gripped between the lower portions of retaining strips 78, 80 which have their upper portions secured together and secured to the pull strips 56, 58 at 82, as by adhesive.

Match striker abrasive strips 84, 86 are secured in confronting relation, as by adhesive, to the lower edge of rear wall 14 and the lower inner edge of panel 40. These abrasive strips are so configurated and sized that, upon a match being sharply detached or withdrawn by a user through channel 72, the match head traverse the confronting abrasive surfaces, and is ignited.

The operation and utilization of the container embodiment of FIGS. 6 to 10 are otherwise generally similar to the use and operation of the container of FIGS. 1 to 5.

It will be appreciated that container devices of the invention may be utilized with items other than cigarettes and the like, such as firecrackers, etc.

Thus, there has been shown and described a novel cigarette and match container which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A cigarette and match container comprising:

front, rear, bottom and side walls cooperating to define a box, a lid hinged to an upper portion of the rear wall for movement between an open and a closed position wherein it engages the upper edges of said rear, front and side walls, panel means mounted on the box in parallel confronting relation with the rear wall and cooperating therewith to define a channel having a lower opening, a match set disposed in said channel and comprising a base and a plurality of individual matches extending therefrom and having stems and heads, and at least one pull strip slidable relative to the box rear wall, the strip being connected at its upper end portion to the lid and at its lower end portion to the match set base, whereby upon movement of the lid from its closed position to its open position the at least one pull strip is moved relative to the box rear wall and the channel to move the match set downwardly to extend portions of the matches outwardly from said channel opening for manual grasping by a user.

2. A cigarette and match container according to claim 1, and further including:

an abrasive match-striking surface on said box front wall and remote from said channel opening and matches extending therefrom.

3. A cigarette and match container according to claim 2, and further including:

an abrasive match-striking surface on said box front wall and remote from said channel opening and matches extending therefrom.

4. A cigarette and match container according to claim 1, wherein:

the matches are detachably secured to the match base with the heads thereof remote from the base, the base being so positioned when the lid is in its open position that the match heads extend outwardly from the channel opening.

5. A cigarette and match container according to claim 1, wherein:

the heads of the matches are detachably retained on the match base, the base being so positioned when the lid is in its open position that the match stems extend outwardly from the channel opening.

6. A cigarette and match container, according to claim 5, and further including:

a pair of abrasive match striking surfaces in confronting relation, one disposed on said box rear wall and the other on said panel adjacent to the channel opening for frictional engagement with one of the match heads upon manual withdrawal of a match when the matches are extended from said opening.

7. A cigarette and match container according to claim 6, wherein:

said matches' heads are spaced from said abrasive strips when the lid is in its closed position and the match set is in retracted position, whereby accidental ignition of matches is prevented.

8. A cigarette and match container according to claim 1, wherein:

said panel means includes a panel confronting the box rear wall and side flaps secured to respective side walls of the box.

9. A cigarette and match container according to claim 1, wherein:

said lid has front, side and rear walls normally closing the upper ends of the box by engaging the upper edges of the box front, side and rear walls, said lid having its rear wall hingedly connected with the box rear wall.

10. A cigarette and match container according to claim 4, wherein:

said lid has front, side and rear walls normally closing the upper ends of the box by engaging the upper edges of the box front, side and rear walls, said lid having its rear wall hingedly connected with the box rear wall.

11. A cigarette and match container according to claim 5, wherein:

said lid has front, side and rear walls normally closing the upper ends of the box by engaging the upper edges of the box front, side and rear walls, said lid having its rear wall hingedly connected with the box rear wall.

12. A cigarette and match container according to claim 1, further including:

an inert liner having a front panel and side flaps, the front panel being disposed adjacent the box front wall and having the side flaps being disposed along the box side walls, said insert liner front panel and side flaps extending above the box front wall and side walls.

13. A cigarette and match container according to claim 4, further including:

an insert liner having a front panel and side flaps, the front panel being disposed adjacent the box front wall and having the side flaps being disposed along the box side walls, said insert liner front panel and side flaps extending above the box front wall and side walls.

14. A cigarette and match container according to claim 5, further including:

an insert liner having a front panel and side flaps, the front panel being disposed adjacent the box front wall and having the side flaps being disposed along the box side walls, said insert liner front panel and side flaps extending above the box front wall and side walls.

15. A cigarette and match container according to claim 1, wherein:

the box front wall has a height lower than the box rear wall, each of the box side walls has its upper edge inclined downwardly from the upper edge of the rear wall to the upper edge of the front wall, and a transverse hinge fold line is defined between the rear wall and the lid.

16. A cigarette and match container according to claim 4, wherein:

the box front wall has a height lower than the box rear wall, each of the box side walls has its upper edge inclined downwardly from the upper edge of the rear wall to the upper edge of the front wall, and a transverse hinge fold line is defined between the rear wall and the lid.

17. A cigarette and match container according to claim 5, wherein:

the box front wall has a height lower than the box rear wall, each of the box side walls has its upper edge inclined downwardly from the upper edge of the rear wall to the upper edge of the front wall, and a transverse hinge fold line is defined between the rear wall and the lid.

* * * * *